US008545288B1

(12) United States Patent
Abood et al.

(10) Patent No.: US 8,545,288 B1
(45) Date of Patent: Oct. 1, 2013

(54) SUPPORT BRA DEVICE

(76) Inventors: Margaret Abood, Sydney (AU); Nilla Carlino, Sydney (AU)

( * ) Notice: Subject to any disclaimer, the term of this patent is extended or adjusted under 35 U.S.C. 154(b) by 249 days.

(21) Appl. No.: 12/984,913

(22) Filed: Jan. 5, 2011

(51) Int. Cl.
*A41C 3/00* (2006.01)

(52) U.S. Cl.
USPC ..... 450/91; 450/67; 450/92

(58) Field of Classification Search
USPC ..... 450/86, 89, 92, 93, 19–21, 23, 24, 450/26, 28, 41, 45–48, 51, 54–58, 65–70, 450/79, 80, 82, 91; 2/247–250, 267, 268, 2/255–260
See application file for complete search history.

(56) References Cited

U.S. PATENT DOCUMENTS 2,593,832 A * 4/1952 Barcley ..... 450/18
2,869,552 A * 1/1959 Smith ..... 450/32
4,185,332 A 1/1980 Jahnig
D278,945 S 5/1985 Stern et al.
5,180,326 A 1/1993 Williams
6,155,906 A 12/2000 May
6,220,924 B1 4/2001 Kobayashi et al.
6,260,242 B1 * 7/2001 Fildan et al. ..... 24/329
6,604,983 B1 8/2003 Denn
6,935,921 B1 8/2005 Eudenbach et al.
7,435,156 B1 * 10/2008 Liu ..... 450/92
7,553,213 B2 6/2009 Smith et al.
D627,948 S 11/2010 Astrom
7,887,390 B2 * 2/2011 Dowe ..... 450/91

* cited by examiner

*Primary Examiner* — Gloria Hale

(57) ABSTRACT

A reversible one-piece support bra device. The support bra device features a front section for covering and supporting a user's breasts. The front section has a first end, a second end, a top edge, and a bottom edge. The first end and second end are for positioning under a user's arms. A back section connected to front section. Together the back second and front section wrap around a portion of a user's torso around the breasts. A strap extends upwardly from the top edge of the front section near the second end. The strap extends to the back section and is for positioning over a user's shoulder.

5 Claims, 5 Drawing Sheets

SUPPORT BRA DEVICE

FIELD OF THE INVENTION

The present invention is directed to a brassiere, more particularly to a brassiere for wearing with one-shouldered garments.

BACKGROUND OF THE INVENTION

Strapless bras, even bras with removable straps (e.g., a "convertible bra"), are generally not comfortable for large-breasted women. Thus, large-breasted women generally refrain from wearing strapless or one-shouldered garments such as evening gowns and loose-fitting shirts. Even small-breasted women may find traditional bras (e.g., convertible bras) uncomfortable for one-shouldered garments. The present invention features an improved support bra device for use with one-shouldered garments. The support bra device provides increased support (e.g., from under arm and diagonally across to shoulder strap) and can be used by women of all sizes. The support bra device of the present invention is also reversible, so it can be used for a left-sided one-shoulder garment or a right-sided one-shoulder garment (or whichever the user prefers). The support bra device of the present invention may be constructed in a variety of styles and designs with varying supports (e.g., no wires, padding, no padding, etc.).

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a reversible one-piece support bra device. In some embodiments, the support bra device comprises a front section for covering and supporting a user's breasts, the front section has a first end, a second end, a top edge, and a bottom edge, the first end and second end being for positioning under a user's arms; a back section connected to the first end and second end of the front section, together the back second and front section wrap around a portion of a user's torso around the breasts; and a strap extending upwardly from the top edge of the front section near the second end, the strap extends to the back section and is for positioning over a user's shoulder.

In some embodiments, the front section comprises cups, padding, underwires, or a combination thereof. In some embodiments, the strap is adjustable in length. In some embodiments, the support bra device further comprises darts disposed along the top edge of the front section. In some embodiments, the support bra device further comprises v spaces disposed along top edge of the front section. In some embodiments, the v spaces comprise an elastic binding.

BRIEF DESCRIPTION OF THE DRAWINGS

FIG. 4 shows the support bra device used on the left side and right side of the user's body.

DESCRIPTION OF PREFERRED EMBODIMENTS

Figure 1:
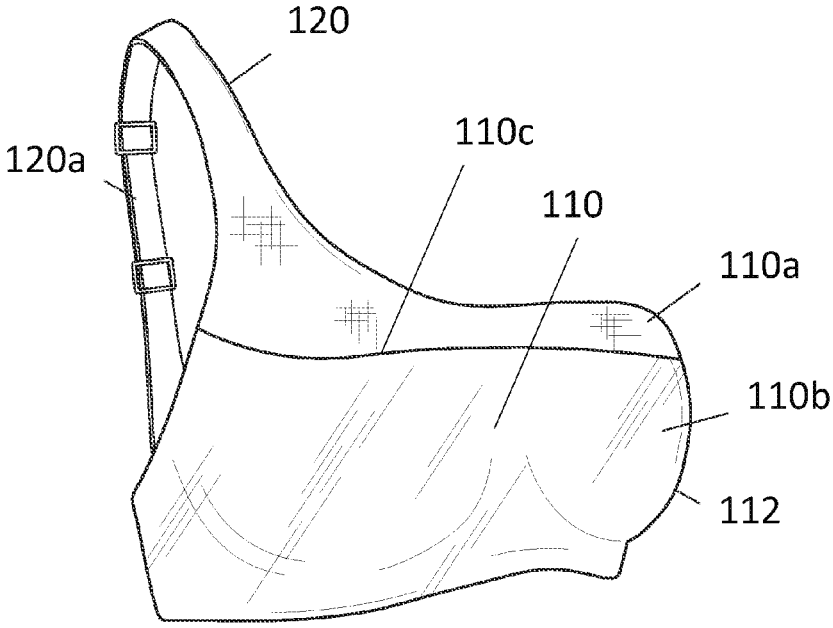
FIG. 1 is a perspective view of the support bra device of the present invention.

The present invention features an improved support bra device 100 for use with one-shouldered garments such as evening gowns and loose-fitting shirts. The support bra device provides increased support (e.g., from under arm and diagonally across to shoulder strap) and can be used by women of all sizes. The support bra device of the present invention is also reversible, so it can be used for a left-sided one-shoulder garment or a right-sided one-shoulder garment (or whichever the user prefers).

Without wishing to limit the present invention to any theory or mechanism, it is believe that the support bra device of the present invention is advantageous because the support bra device provides a great deal of support for women of all sizes. For example, the support bra device 100 helps prevent one breast from sagging as compared to the other. The support bra device 100 also allows women to comfortably wear one-shouldered clothing styles (shirts, dresses). The support bra device 100 is convenient and is an all-in-one garment, thus users don't worry about losing detachable straps. The reversibility of the support bra device 100 allows users to use the support bra device 100 for either left-sided or right-sided garments.

Referring now to FIGS. 1-8, the support bra device 100 of the present invention is a reversible one-piece garment. The support bra device 100 comprises a front section 110 for covering and supporting the user's breasts, and a back section 210 (the front section 110 and back section 210 are connected together to form a garment that can wrap around a users torso and breast area). In some embodiments, a reversible clip 122 is disposed in the back section 210, which functions to clip the support bra device 100 around the user's torso/breast area. Such clips are well known to one of ordinary skill in the art.

The front section 110 may be designed with cups 112 (e.g., with or without padding, with or without underwires, etc.) As compared to standard bras, the front section 110 of the support bra device 100 of the present invention covers a large portion of the user's chest (e.g., the front center area does not dip down). Extending upwardly from a first side of the front section 110 is a strap 120. The strap 120 extends over the user's shoulder and to the back section 210. This configuration provides strong support from under the arm to the opposite shoulder. In some embodiments, the strap 120 is adjustable in length (e.g. via an adjustment component 120*a*, e.g., a buckle, for example). The strap 120 is fixedly attached to the front section 110 and back section 210 (generally the strap 120 is the same garment as the bra device 100 is a one-piece garment).

The top portion of the front section 110 (and a portion of the strap 120) of the support bra device 100 is constructed from a first fabric 110*a*, the first fabric 110*a* being a stretchable fabric or a woven fabric. The bottom portion of the front section 110 and the back section 210 are constructed from a second fabric 110*b*, the second fabric 110*b* being a bias fabric. Stretchable fabrics, woven fabrics, and bias fabrics are well known to one of ordinary skill in the art. The first fabric 1108 and second fabric 110*b* may be connected via a seam 110*c*. In some embodiments, the first fabric 110*a* is placed on the straight grain in the direction side to side. In some embodiments, the first fabric 110*a* is lace.

Figure 2:
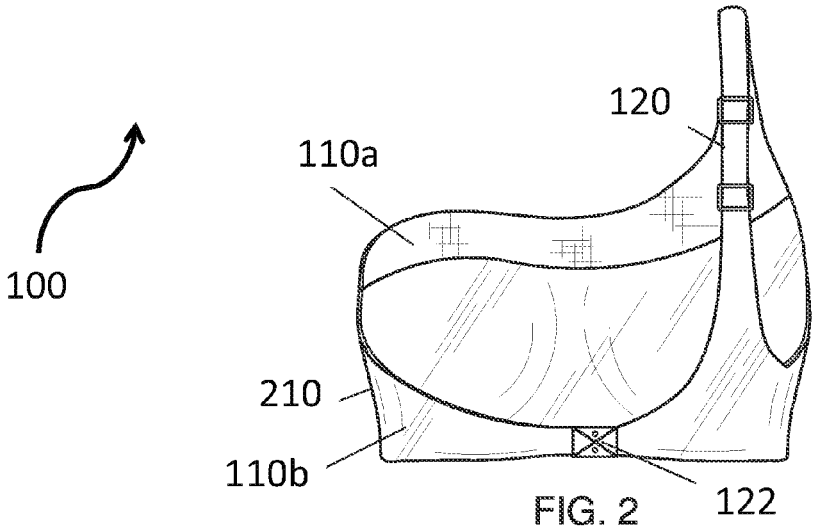
FIG. 2 is a back view of the support bra device of FIG. 1.
Figure 3:
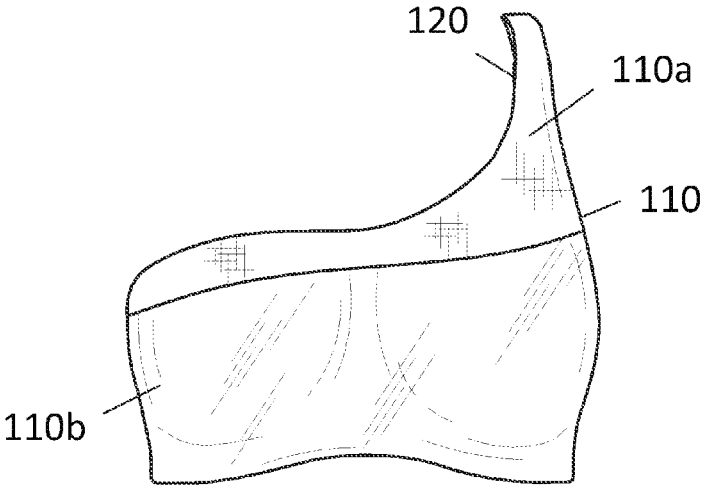
FIG. 3 is a front view of the support bra device of FIG. 1.
Figure 4:
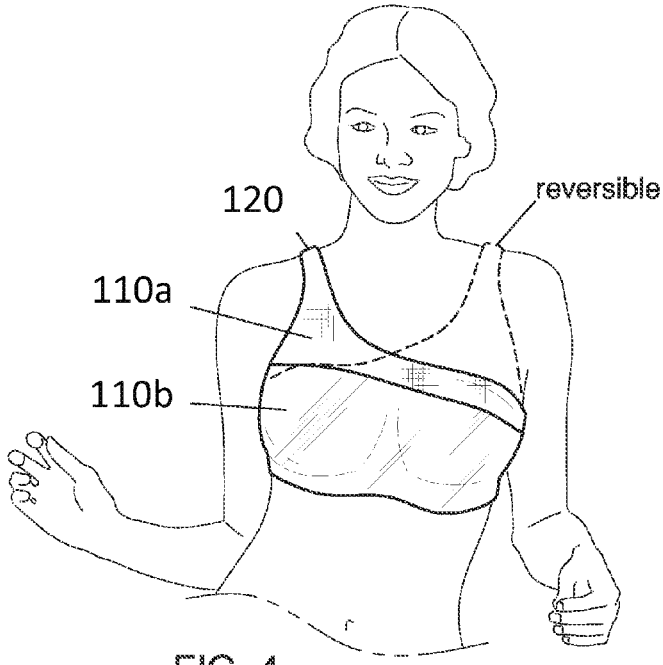
FIG. 4 is an in-use view of the support bra device of FIG. 1. The support bra device is reversible.

As shown in FIG. 2, the back section 210 may be a continuous piece. However, in some embodiments, a clip is disposed in the back section 210 for securing the support bra device 100 on the user's body. Clips on the backs of bras are well known to one of ordinary skill in the art.

The support bra device 100 of the present invention may be constructed in a variety of styles, colors, sizes, and designs. For example, in some embodiments, the support bra device 100 comprises a detachable back shoulder strap and/or varying loops to adjust left to right to accommodate any garment design variations. In some embodiments, the support bra device 100 is a one-way bra (not reversible) and is constructed having a left shoulder strap or a right shoulder strap. In some embodiments, the support bra device 100 comprises padding or does not comprise padding. In some embodiments, the support bra device 100 comprises underwires or does not comprise underwires.

Figure 5:
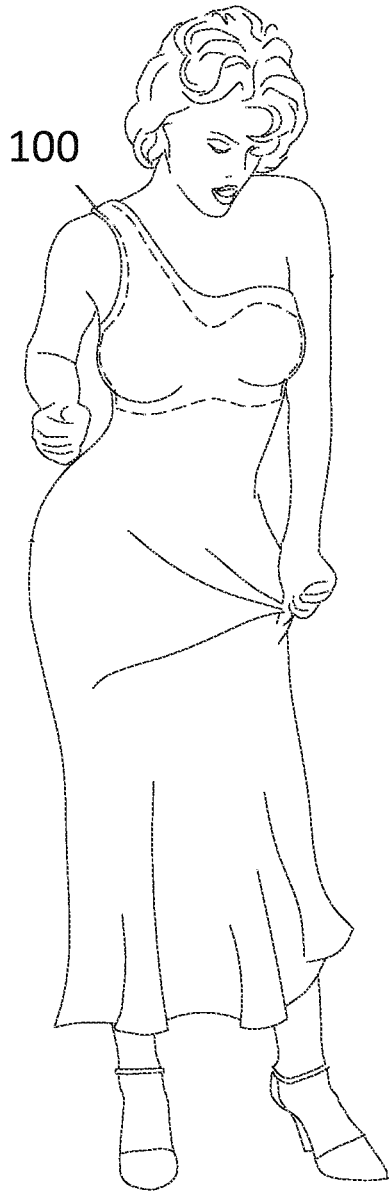
FIG. 5 is an in-use view of an alternative embodiment of the support bra device of the present invention. For example the front section of the device is low cut to accommodate low cut garments.

In some embodiments, the support bra device 100 has a low front to cater to lower cut garments (e.g., see FIG. 5). In some embodiments, the support bra device 100 is constructed in a sport version, for example the support bra device can be pulled overhead without any clips, wires, or padding. In some embodiments, the support bra device 100 lacks the back clip and instead has adjustable hook and eyes to widen and/or expand the support bra device 100. In some embodiments, the support bra device 100 can be worn with a clip at the front center for garments that may be lower in the front (e.g., the clip may gather and pull the front center down and together). The support bra device 100 may resemble a normal strapless bra that dips down at the front center with an all-in-one strap that extends over one shoulder to the back horizontal strap and an extra strap that comes from the lower inside from center of the cup on the opposite side meeting up with the other strap just above the other cup (in some embodiments, it may have a solid piece of fabric covering the entire area between both straps at the front). In some embodiments, the support bra device 100 is constructed in vibrant colors, animal prints, bright colors, pastel colors, etc. The support bra device 100 may comprise lace or other fabrics for décor.

Figure 6:
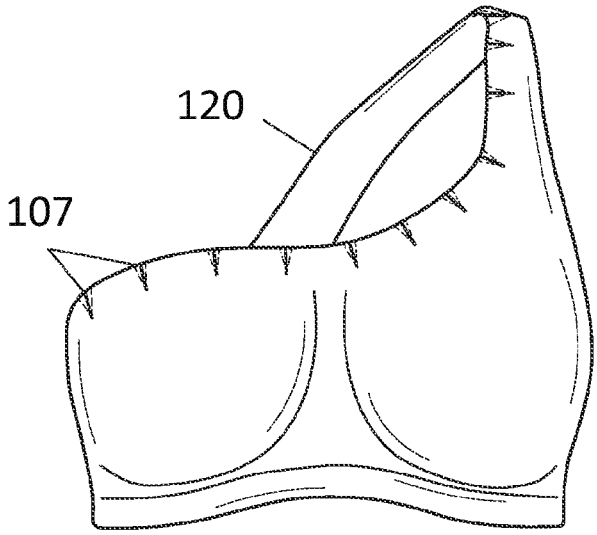
FIG. 6 is a front view of an alternative embodiment of the support bra device of the present invention.
Figure 7:
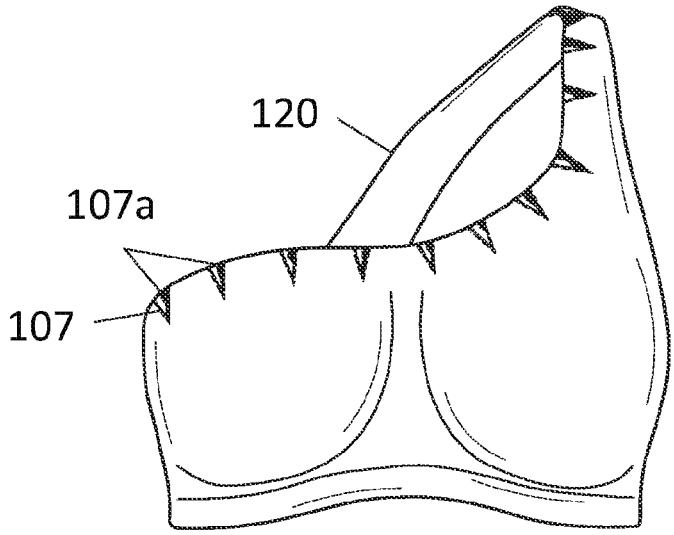
FIG. 7 is a front view of an alternative embodiment of the support bra device of the present invention.
Figure 8:
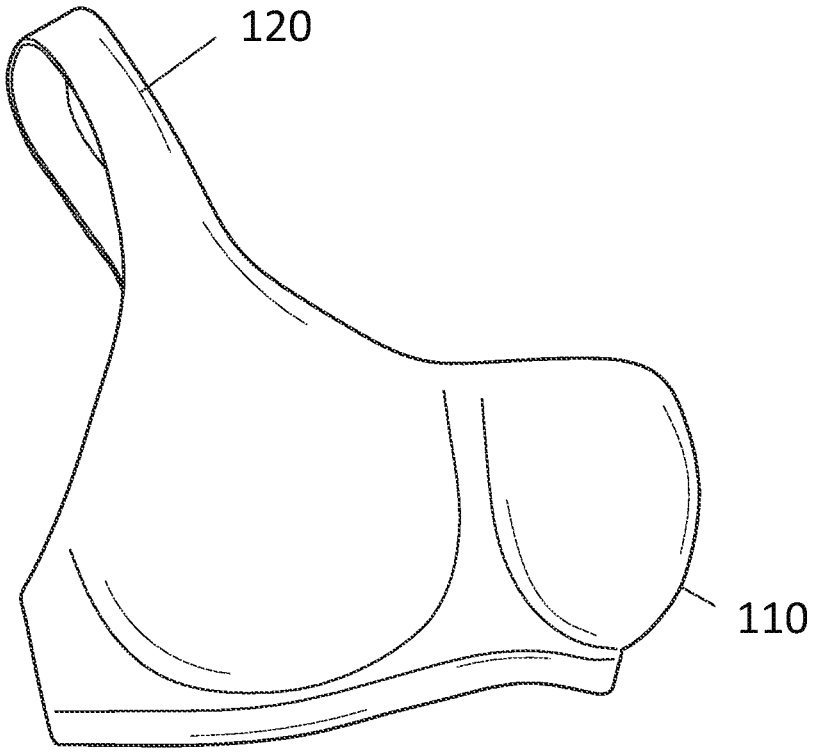
FIG. 8 is a perspective view of the support bra device of the present invention.

As shown in FIG. 6 and FIG. 7, in some embodiments, the support bra device 100 comprise small tucks (either open or stitched down flat) as small darts 107 disposed along the front top edge of the support bra device 100. The darts 107 may help to further strengthen support from under the arm to the opposite shoulder at the front. In some embodiments, the support bra device 100 comprises small v spaces 109 disposed along front top edge of the support bra device 100 (e.g., along the front from under the arm to the opposite shoulder) stitched firmly in place with an elastic binding 107*a*.

The disclosures of the following U.S. Patents are incorporated in their entirety by reference herein: U.S. Pat. No. 6,604,983; U.S. Pat. No. 4,185,332; U.S. Pat. No. 5,180,326; U.S. Pat. No. 6,155,906; U.S. Pat. No. 6,935,921; U.S. Pat. No. 7,553,213; U.S. Pat. No. 6,220,924; U.S. Design Pat. No. D278,945.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A reversible one-piece support bra comprising:

(a) a front section for covering and supporting a user's breasts, the front section has a first end, a second end, a top edge, and a bottom edge, the first end and second end being for positioning under a user's arms;

(b) a back section connected to the first end and second end of the front section, together the back second and front section wrap around a portion of a user's torso around the breasts;

(c) a reversible clip disposed in the back section functioning to secure the front section and back section around a user's torso and breasts; and (d) a strap extending upwardly from the top edge of the front section near the second end, the strap extends to the back section and is for positioning over a user's shoulder;

wherein a series of v-shaped cut out spaces are disposed along top edge of the front section and along strap, wherein the spaces comprise a v-shaped elastic binding wherein the support bra is reversible such that it can be used for a left-sided one-shoulder garment or a right-sided one-shoulder garment;

wherein a top portion of the front section and a portion of the strap are constructed from a first, stretchable fabric placed on a straight grain from side to side wherein a bottom portion of the front section and the back section are constructed from a second fabric placed on a bias cut.

2. The support bra device of claim 1, wherein the front section comprises cups, padding, underwires, or a combination thereof.

3. The support bra device of claim 1, wherein the strap is adjustable in length.

4. The support bra device of claim 1 further comprising darts disposed along the top edge of the front section.

5. A reversible one-piece support bra consisting of:

(a) a front section for covering and supporting a user's breasts, the front section has a first end, a second end, a top edge, and a bottom edge, the first end and second end being for positioning under a user's arms;

(b) a back section connected to the first end and second end of the front section, together the back second and front section wrap around a portion of a user's torso around the breasts;

(c) a reversible clip disposed in the back section functioning to secure the front section and back section around a user's torso and breasts; and (d) a strap extending upwardly from the top edge of the front section near the second end, the strap extends to the back section and is for positioning over a user's shoulder;

wherein a series of v-shaped cut out spaces are disposed along top edge of the front section and the strap, wherein the spaces comprise a v-shaped elastic binding wherein the support bra is reversible such that it can be used for a left-sided one-shoulder garment or a right-sided one-shoulder garment;

wherein a top portion of the front section and a portion of the strap are constructed from a first, stretchable fabric placed on a straight grain from side to side, wherein a bottom portion of the front section and the hack section are constructed from a second fabric placed on a bias cut.

* * * * *